United States Patent [19]

Grunikiewicz et al.

[11] Patent Number: 4,543,720

[45] Date of Patent: Oct. 1, 1985

[54] CUTTING TOOL

[75] Inventors: Peter Grunikiewicz, Stuttgart; Karl Gommel, Ditzingen; Klaus M. Junginger, Heilbronn, all of Fed. Rep. of Germany

[73] Assignee: C. & E. Fein GmbH & Co., Stuttgart, Fed. Rep. of Germany

[21] Appl. No.: 630,517

[22] Filed: Jul. 13, 1984

[30] Foreign Application Priority Data

Aug. 31, 1983 [DE] Fed. Rep. of Germany ..... 8325025

[51] Int. Cl.[4] ..... B26B 9/02; B26B 7/00

[52] U.S. Cl. ..... 30/272 R; 30/272 A; 30/277; 29/239; 83/651

[58] Field of Search ..... 83/651; 30/272 R, 272 A, 30/287, 294, 277; 29/235, 239, 270

[56] References Cited

U.S. PATENT DOCUMENTS

| | | | |
|---|---|---|---|
| 3,924,327 | 12/1975 | Edwards | 30/277 |
| 4,080,734 | 3/1978 | Barbour | 30/277 X |
| 4,194,852 | 4/1980 | Ayers et al. | 29/239 |
| 4,215,475 | 8/1980 | Morford et al. | 30/272 R |

*Primary Examiner*—Donald R. Schran
*Attorney, Agent, or Firm*—Max Fogiel

[57] ABSTRACT

A cutting tool for separating beads of adhesive, with a U-shaped cross-section consisting of two flanks connected by a web. One flank is a sickle-shaped blade and the other is employed to attach the tool to an oscillating driveshaft. The center of curvature of the sickle shape extends toward the point at which the cutting tool is secured. The web between the tensioning shank and the blade may have ridges. These ridges extend to the sides of the tensioning shank and blade. The web is longitudinally curved between the tensioning shank and the blade, and has round edges.

10 Claims, 6 Drawing Figures

CUTTING TOOL

BACKGROUND OF THE INVENTION

The present invention relates to a cutting tool for dividing beads of adhesive.

Panes of glass are now being glued in place in automotive technology. The mass of adhesive, usually artificial rubber or a single-constituent polyurethane adhesive, is placed between the window frame and the pane. The bead of adhesive must be removed in order to take out the pane.

German OS No. 3 210 212 discloses a cutting tool that can be used to separate the bead and subsequently take out the pane. The tool is powered with a drive mechanism that can oscillate when in operation. The tool is oblong and has a concave blade.

When the bead of adhesive is to be separated, the blade must be introduced from inside the vehicle into the joint between the pane and the window frame. This operation is not always easy because access to the edge of the pane, through the fittings for instance, is very restricted.

SUMMARY OF THE INVENTION

The object of the present invention is to provide a cutting device that has greater freedom of movement.

This object is attained in accordance with the invention in a cutting tool that allows the bead of adhesive to be separated from outside the vehicle. The cutting tool is bent into the shape of a U. The U is dimensioned to allow the tool to be introduced between the window-frame cross-section and the end of the pane. It has turned out to be practical for the blade that constitutes one shank of the U to be shaped like a sickle. The center of curvature of the sickle shape is in the vicinity of the center of rotation of the oscillating drive mechanism and the radius is selected in such a way that the blade cuts deeper into the bead of adhesive at each stroke.

The web between the blade and the tensioning shank is provided with at least one ridge to prevent the two shanks of the U-shaped tool from drifting apart. The ridges extend slightly farther, up to the side of each shank. The same effect can be obtained by curving the web.

Since the material that the bead of adhesive is made out of is elastic and tends to grab blade, depressions are provide on each side of the blade to allow it to cut more readily.

The blade can also be blunted on one side to reduce costs and increase safety. Practice has demonstrated that the blade should have a lip angle of between 6° and 10°.

The tensioning shank of the tool is provided with a perforation for fastening it to the drive mechanism. It is practical for the perforation to be an equilateral polygon, which makes it possible to attach the tool positively to the drive mechanism in various positions.

The cutting tool in accordance with the invention is reliable to operate because it is introduced between the pane and the window frame and will not work its way out unintendedly.

Some preferred embodiments of the invention will now be described with reference to the attached drawings, wherein

DETAILED DESCRIPTION OF THE PREFERRED EMBODIMENTS

Figure 1:
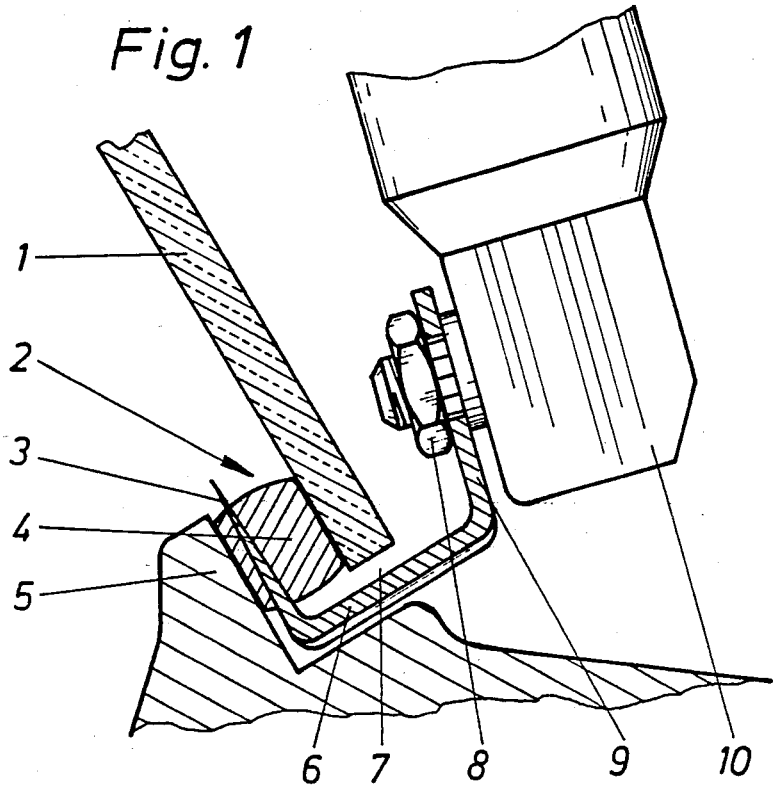
FIG. 1 is a section through both the window frame and the pane of glass with the cutting tool in the cutting position.

A pane 1 of glass is positioned in relation to a window frame 5 in such a way as to leave an interval 2 between them. Interval 2 is filled in by a bead 4 of adhesive. Bead 4 secures pane 1 against window frame 5. To separate bead 4 when pane 1 is to be replaced, the blade 3 of a cutting tool is introduced through a gap 7 in interval 2, penetrating the bead as illustrated in FIG. 1.

The cutting tool is in the shape of a U that consists of blade 3, a web 6, and a tensioning shank 9. Tensioning shank 9 is fastened to an oscillating drive mechanism 10 by means of a nut 8.

Figure 2:
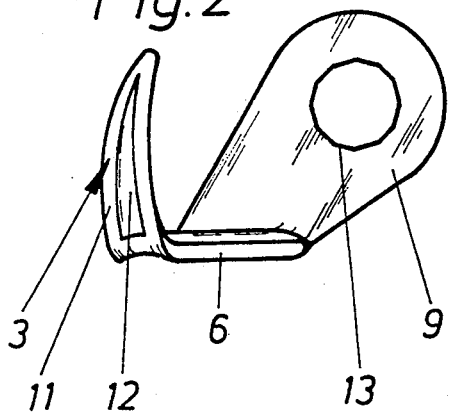
FIG. 2 is a side view of a cutting tool like that illustrated in FIG. 1.

As will be evident from FIG. 2, there is a perforation 13 in tensioning shank 9 for securing the cutting tool. Perforation 13 fits over a matching driveshaft on drive mechanism 10. Perforation 13 is preferably an equilateral polygon. The drive is accordingly transmitted positively. It is also accordingly possible to mount the cutting tool on the driveshaft in various positions. The web 6 in the illustrated embodiment is curved to increase stability.

Figure 3:
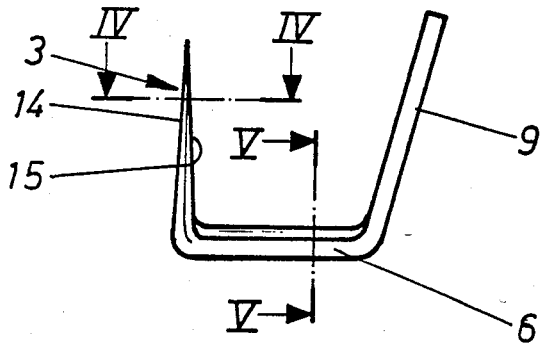
FIG. 3 is a front view of the cutting tool.
Figure 4:
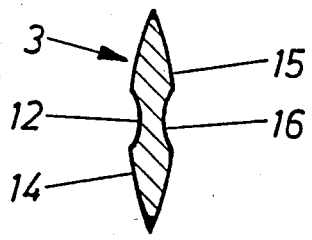
FIG. 4 is a section along the line IV—IV in FIG. 3.

As will be evident from FIG. 3, blade 3 constitutes the second shank of the U. The edge of the blade faces out to allow the bead of adhesive to be penetrated. Both sides 14 and 15 of blade 3 have depressions 12 and 16 to prevent the adhesive from grabbing it.

Figure 5:
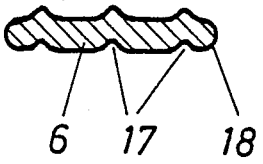
FIG. 5 is a section along the line V—V in FIG. 3.
Figure 6:
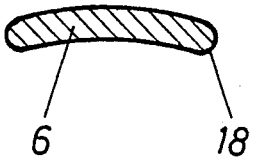
FIG. 6 is a variant of FIG. 5.

FIGS. 5 and 6 illustrate web 6. The web 6 in FIG. 5 has ridges 17 to increase stability. That in FIG. 6 is curved for the same purpose.

The web 6 illustrated in FIG. 6 has rounded edges 18 to soften the impact of the edges of the web against the edge of glass pane 1.

We claim:

1. Cutting tool for separating beads of adhesive, comprising two flanks connected by a web and forming a U-shaped cross-section, one flank comprising a sickle-shaped blade and the other flank comprising means for attaching the tool to an oscillating driveshaft, wherein the improvement comprises that the center of curvature of the sickle shape extends toward the point at which the cutting tool is attached.

2. Cutting tool as in claim 1, wherein one of said flanks comprises further a tensioning shank, said web between the tensioning shank and said blade having ridges.

3. Cutting tool as defined in claim 2, wherein said ridges extend to the sides of the tensioning shank and blade.

4. Cutting tool as defined in claim 1, wherein one of said flanks comprises further a tensioning shank, said web being longitudinally curved between the tensioning shank and the blade.

5. Cutting tool as defined in claim 1, wherein said web has rounded edges.

6. Cutting tool as defined in claim 1, wherein said blade has depressions extending along the blade.

7. Cutting tool as defined in claim 1, wherein said blade has a blunt back.

8. Cutting tool as defined in claim 1, wherein said blade has a lip angle of between 6° and 10°.

9. Cutting tool as defined in claim 1, wherein one of said flanks comprises further a tensioning shank, said tensioning shank having a perforation.

10. Cutting tool as defined in claim 9, wherein said perforation is an equilateral polygon.

* * * * *